US006985123B2

(12) United States Patent
Göttl

(10) Patent No.: US 6,985,123 B2
(45) Date of Patent: Jan. 10, 2006

(54) DUAL-POLARIZATION ANTENNA ARRAY

(75) Inventor: Maximilian Göttl, Frasdorf (DE)

(73) Assignee: Kathrein-Werke KG, Rosenheim (DE)

( * ) Notice: Subject to any disclaimer, the term of this patent is extended or adjusted under 35 U.S.C. 154(b) by 0 days.

(21) Appl. No.: 10/433,953

(22) PCT Filed: Sep. 27, 2002

(86) PCT No.: PCT/EP02/10885

§ 371 (c)(1),
(2), (4) Date: Jun. 9, 2003

(87) PCT Pub. No.: WO03/034547

PCT Pub. Date: Apr. 24, 2003

(65) Prior Publication Data

US 2004/0051677 A1 Mar. 18, 2004

(30) Foreign Application Priority Data

Oct. 11, 2001 (DE) ..... 101 50 150

(51) Int. Cl.
*H01Q 9/28* (2006.01)
*H01Q 21/00* (2006.01)

(52) U.S. Cl. ..... 343/853; 343/700 MS; 343/795

(58) Field of Classification Search ..... 343/700 MS, 343/853, 795, 810, 813, 814, 820, 821, 850; H01Q 9/28, H01Q 21/00
See application file for complete search history.

(56) References Cited

U.S. PATENT DOCUMENTS 3,475,758 A 10/1969 Vito
4,434,425 A 2/1984 Barbano
4,464,663 A * 8/1984 Lalezari et al. ..... 343/700 MS
5,173,715 A 12/1992 Rodal et al.
5,481,272 A 1/1996 Yarsunas
5,532,707 A 7/1996 Klinger et al.
5,629,713 A 5/1997 Mailandt et al.
5,917,455 A 6/1999 Huynh et al.
5,940,044 A 8/1999 Smith (Continued)

FOREIGN PATENT DOCUMENTS

DE 10 11 010 6/1957

(Continued)

OTHER PUBLICATIONS

Alois Krischke: "Rothammols Antennenbuch", 1995, Frankh-Kosmos, Stuttgart, Germany, XP002171898, 225590, Abblidung 13.6.

(Continued)

*Primary Examiner*—Hoanganh Le
(74) *Attorney, Agent, or Firm*—Nixon & Vanderhye P.C.

(57) ABSTRACT

An improved antenna array, having at least two groups of individual antenna elements comprising a dipole square and/or patch antenna elements with a square antenna element structure. Individual antenna element arranged at least horizontally offset with respect to one another are provided for each of the two polarizations which are at right angles to one another. At least two additional antenna elements are horizontally offset with respect to one another, and/or at least two pairs of vertically aligned individual antenna elements, which are arranged with a horizontal offset with respect to one another, are provided for each of the two orthogonal polarizations. The individual antenna elements which are in each case arranged with a horizontal offset with respect to one another and are aligned parallel to one another are fed with different phase angles as a function of the depression angle.

28 Claims, 7 Drawing Sheets

U.S. PATENT DOCUMENTS

| | | | | |
|---|---|---|---|---|
| 5,966,102 | A * | 10/1999 | Runyon | 343/820 |
| 6,023,244 | A | 2/2000 | Snygg et al. | |
| 6,025,812 | A | 2/2000 | Gabriel et al. | |
| 6,028,563 | A | 2/2000 | Higgins | |
| 6,310,584 | B1 | 10/2001 | Reece et al. | |
| 6,339,407 | B1 * | 1/2002 | Gabriel et al. | 343/797 |
| 6,529,172 | B2 * | 3/2003 | Zimmerman | 343/797 |
| 6,621,465 | B2 * | 9/2003 | Teillet et al. | 343/797 |
| 6,697,029 | B2 * | 2/2004 | Teillet et al. | 343/797 |
| 6,819,300 | B2 | 11/2004 | Göttl | |
| 2003/0214452 | A1 * | 11/2003 | Ippolito | 343/797 |
| 2004/0056818 | A1 * | 3/2004 | Sledkov | 343/797 |

FOREIGN PATENT DOCUMENTS

| | | | |
|---|---|---|---|
| DE | 11 60 513 | | 1/1964 |
| DE | 4302905 | C1 | 3/1994 |
| DE | 19823749 | A1 | 12/1999 |
| DE | 19860121 | A1 | 7/2000 |
| DE | 199 38 862 | C1 | 3/2001 |
| DE | 100 12 809 | A1 | 9/2001 |
| EP | 0 362 079 | | 4/1990 |
| EP | 0 431 764 | | 6/1991 |
| EP | 0 685 900 | | 12/1995 |
| WO | 82/02119 | | 6/1982 |
| WO | 97/22159 | | 6/1997 |
| WO | 98/01923 | | 1/1998 |
| WO | 98/36472 | | 8/1998 |
| WO | 98/37592 | | 8/1998 |
| WO | 98/48480 | | 10/1998 |
| WO | WO 98/54787 | | 12/1998 |
| WO | 99/17403 | | 4/1999 |
| WO | WO 99/62139 | | 12/1999 |
| WO | 01/24312 | A1 | 9/2000 |
| WO | 01/69714 | A1 | 3/2001 |

OTHER PUBLICATIONS

Rothammel, K; Antennenbuch, Telekosmosverlay, Franckhesche Verlagshandlung, Stuttgart, 8, Aufl. 1984, S 417-425.

Beckmann C et al.: "Antenna Systems for Polarization Diversity", Microwave Journal, Bd. 40, Nr. 5. 1. (May 1997).

Heilmann, A.: Antennen, Zweiter Teil, Wien/Zurich, 1970, S. 47-50.

Zehentner, H.: Neus Sendeantonne fur terrestrisches Fernsehen . . . , Berlin, Offenbach, 1994, S. 357-362.

"Dual-Frequency Patch Antennas"; S. Maci and G. Biff, Gentili, IEEE Antennas and Propagation Magazine, vol. 39. No. 6, Dec. 1997.

* cited by examiner

DUAL-POLARIZATION ANTENNA ARRAY

CROSS-REFERENCES TO RELATED APPLICATIONS

This application is the US national phase of international application PCT/EP02/10885 filed 27 Sep. 2002, which designated the US.

STATEMENT REGARDING FEDERALLY SPONSORED RESEARCH OR DEVELOPMENT

Not applicable.

FIELD

The technology herein relates to a dual-polarized antenna array.

BACKGROUND AND SUMMARY

Dual-polarized antennas are preferably used in the mobile radio field for 800 MHz to 1000 MHz, and in the band from 1700 MHz to 2200 MHz. The antennas transmit and receive two orthogonal polarizations. In particular, the use of two linear polarizations aligned at +45° and −45° with respect to the vertical or horizontal have been proven in practice. Dual-polarized antennas aligned in this way are also frequently referred to as X-polarized antennas. In order to optimize the illumination of the supply area, without needing to mechanically depress the antenna, the polar diagram is depressed electrically by changing the phase angles of the individual antenna elements of the antenna array. This is done using phase shifters which, owing to the stringent intermodulation requirements and the high transmission power levels, are preferably in the form of mechanically moving structures with variable line lengths. Phase shifters such as these are known, for example, from DE 199 38 862 C1.

Although the possibility of depressing the antenna to different extents by varying the phase angles of the individual antenna elements is intrinsically very highly advantageous for adaptation of the illumination in situ, it has been found to be disadvantageous in the case of antennas having a polarization of +/−45°. However, varying the depression of the vertical polar diagram, that is to say varying the phase angles of the individual antenna elements, shifts the horizontal polar diagrams for the respective polarization through an angle in azimuth.

In this case, it has been found to be particularly disadvantageous that, when the vertical polar diagram depression is changed, the horizontal polar diagrams for the respective polarization are not only shifted but that, particularly when the vertical polar diagram is depressed, the horizontal polar diagrams for the +45° polarization and for the −45° polarization are shifted through an azimuth angle in the opposite directions to one another. This drifting apart from one another in opposite directions for the +45° polarization to the −45° polarization can be explained, inter alia, by the fact that the radiation characteristic of the individual antenna elements is not rotationally symmetrical with respect to the main lobe direction. In other words, the polar diagram of the individual antenna elements in most cases is no longer exactly symmetrical with respect to the vertical axis due to the specific configuration of the polarization of +45° on the one hand and −45° on the other hand. If any axis of symmetry were to be present at all, it would preferably intrinsically run aligned at +/−45° with respect to individual groups of antenna elements. When the main lobe direction of the antenna array is depressed electrically, this now results, however, in the main lobe direction being shifted, which is also referred to as tracking. This thus results in the polar diagram being undesirably dependent on respectively selected depression angles.

The problem which has been explained occurs exclusively in the case of polarizations aligned at oblique angles, that is to say primarily in the case of polarizations which are aligned at +45° and −45° with respect to the horizontal or vertical.

Against the background of this prior art, the technology herein improves a dual-polarized single-band, dual-band and/or multiband antenna array such that, with a depression angle which can be set differently, it is possible to compensate better for, or even to prevent, the polarization-dependent polar diagrams drifting apart from one another.

It is surprising that, according to an exemplary illustrative non-limiting implementation, this makes it possible not only to set the depression angle of a dual-polarized antenna array differently but to reduce, or even completely to avoid, the individual radiation characteristics for the +45° polarization and for the −45° polarization drifting apart from one another as a function of the depression angle, which can be preset to be different.

According to a non-limiting implementation, this can be achieved by also providing a compensation device in addition to the individual antenna element arrangements. These individual antenna element arrangements, for example, are arranged one above the other with a vertical offset, and transmit and receive using two polarizations which are orthogonal to one another, for example +45° and −45°. According to an exemplary illustrative non-limiting implementation, this compensation device is constructed such that it comprises additional antenna elements or antenna element arrangements, whose polar diagrams do not overall drift apart from one another in the azimuth direction when the vertical polar diagram of the antenna array is depressed but, conversely, are shifted in the opposite sense relative to this. This therefore results in an overall polar diagram in which, despite the down-tilt angle being increasingly depressed, that is despite the increasingly greater depression of the vertical polar diagram, the drifting apart of the horizontal components of the polar diagram in the azimuth angle direction is minimized, or even prevented. If required, it would even be possible to provide overcompensation, in which case it would be feasible to provide even a slight angle change in the opposite sense for the horizontal polar diagrams for the +45° to the −45° polarization.

One preferred exemplary non-limiting implementation provides for the compensation device for the relevant polarization to in each case comprise at least one pair of dipole antenna elements or at least one pair of feed points for at least one patch antenna element, which are arranged at least horizontally offset with respect to one another (and possibly also vertically in addition), and which are in this case fed with a phase difference which is dependent on the depression angle of the antenna array. This can preferably be produced by means of a phase shifter assembly located in the antenna.

It may be regarded as being particularly advantageous that it is also possible, in a development of an exemplary illustrative non-limiting implementation, to control the compensation level as well, in order to avoid tracking. The control process may in this case be carried out by splitting the power which is fed to the individual antenna elements.

An exemplary illustrative non-limiting implementation may be implemented using different antenna element types. In this case, furthermore, not only corresponding individual antenna elements but also group antenna elements may be used by an antenna array.

The antenna array may therefore, for example, comprise a number of cruciform dipoles or cruciform-like dipole structures arranged vertically one above the other. The individual antenna element arrangements which are arranged vertically one above the other may likewise all or in some cases comprise dipole squares or dipole structures similar to dipole squares. It is equally possible for an exemplary illustrative non-limiting implementation to be implemented entirely or partially using patch antenna elements which, for example, are provided with a feed structure which comprises two feed points or four feed points, in which case the relevant polarizations can be received or transmitted at angles of +45° and −45°.

Thus, in other words, individual antenna elements which by way of example are located such that they are horizontally offset, or antenna element groups in the antenna array which are located such that they are offset horizontally can be compensated for with respect to one another in order to avoid tracking when their emission angle is depressed, This may be accomplished, for example, by choosing different phase angles for at least two antenna elements, which are located horizontally offset with respect to one another, as a function of the elevation angle or depression angle.

If, for example, square antenna element structures, that is to say in particular square dipole structures in the form of a dipole square, are used, then this antenna element arrangement comprises two individual antenna elements. These two individual antenna element may have a horizontal offset with respect to one another, for each polarization when aligned to receive and to transmit polarizations at angles of +45° and −45°. In this case, the pairs of mutually aligned dipole antenna elements in a dipole square may be driven with a phase difference which is dependent on the depression angle of the antenna array in order to produce the desired compensation effect. This may be done, for example, by the antenna array having only one such dipole square which is used for compensation, or having a number of such dipole squares. This can be implemented in a particularly advantageous manner by an antenna array according to an exemplary illustrative non-limiting implementation comprising, for example, two dipole squares which are arranged vertically one above the other. The respectively parallel adjacent dipoles of the two dipole squares may be arranged vertically one above the other and connected together in phase. That is to say, they may at least being connected together with a fixed phase relationship between them. The respective further dipoles which are parallel to them in the relevant dipole square may be fed with different phase angles as a function of the depression angle.

A solution which is comparable to this extent may also be obtained by using patch antenna elements which, for example, each comprise pairs of interacting feed points for each of the two polarizations.

However, an exemplary illustrative non-limiting implementation may also be used for other antenna structures, for example using cruciform antenna elements (dipole cruciforms or patch antenna elements with cruciform antenna element structures). There, the respectively parallel individual antenna elements may be provided with different components offset only in the vertical direction and possibly not in the horizontal direction. However, in this case, but of course also in the other abovementioned cases, it is at least possible to use additional antenna elements which are arranged with a lateral, horizontal offset. Hence, a further development of an exemplary illustrative non-limiting implementation provides for additional antenna elements to be provided in addition to the other antenna elements which are arranged one above the other, which additional antenna elements are located offset at least horizontally and in this case preferably symmetrically with respect to a vertical axis of symmetry or plane of symmetry, with the relevant antenna elements for each polarization being electrically connected to the associated output of a phase shifter assembly. This also results in a completely novel type of compensation according to the an exemplary illustrative non-limiting implementation which allows the illumination areas to drift apart from one another when the vertical polar diagram is depressed electrically.

The additional antenna elements which are used for the compensation device may thus be produced from dipole structures which are arranged with a horizontal offset. In particular, individual dipoles for example in the form of a cruciform or square dipole structure may be used. Alternatively, a patch antenna element with at least two feed points or two pairs of feed points for each of the two polarizations may be employed. Furthermore, however, it is even possible to use vertically aligned individual antenna elements which are arranged in pairs with a horizontal offset, preferably with respect to a vertical central plane of symmetry. Each pair of vertically aligned individual antenna elements, or a corresponding pair of patch antenna elements, may be provided for each of the polarizations that are to be compensated in a corresponding manner.

In summary, it can thus be stated that the antenna array may comprise widely differing antenna elements and antenna element arrangements whose polar diagrams normally drift apart from one another as the polar diagram is depressed to an increasingly greater extent in the horizontal direction, and hence in the azimuth direction. According to exemplary illustrative non-limiting implementation, compensation devices are provided which are formed from widely differing antenna elements, antenna element arrangements or group antenna elements. Those individual antenna elements or feed points of a patch antenna element can be driven with different phase angles so as to counteract their polar diagrams drifting apart from one another, so as to reduce or even prevent such drifting apart and, if required, even to overcompensate for it. The compensation level can be set or preselected as appropriate by means of the number of antenna elements associated with the compensation device. Power splitting can be carried out in a corresponding manner.

BRIEF DESCRIPTION OF THE DRAWINGS

These and other features and advantages will be better and more completely understood by referring to the following detailed description of exemplary non-limiting illustrative implementations in conjunction with the drawings of which.

DETAILED DESCRIPTION

Figure 1:
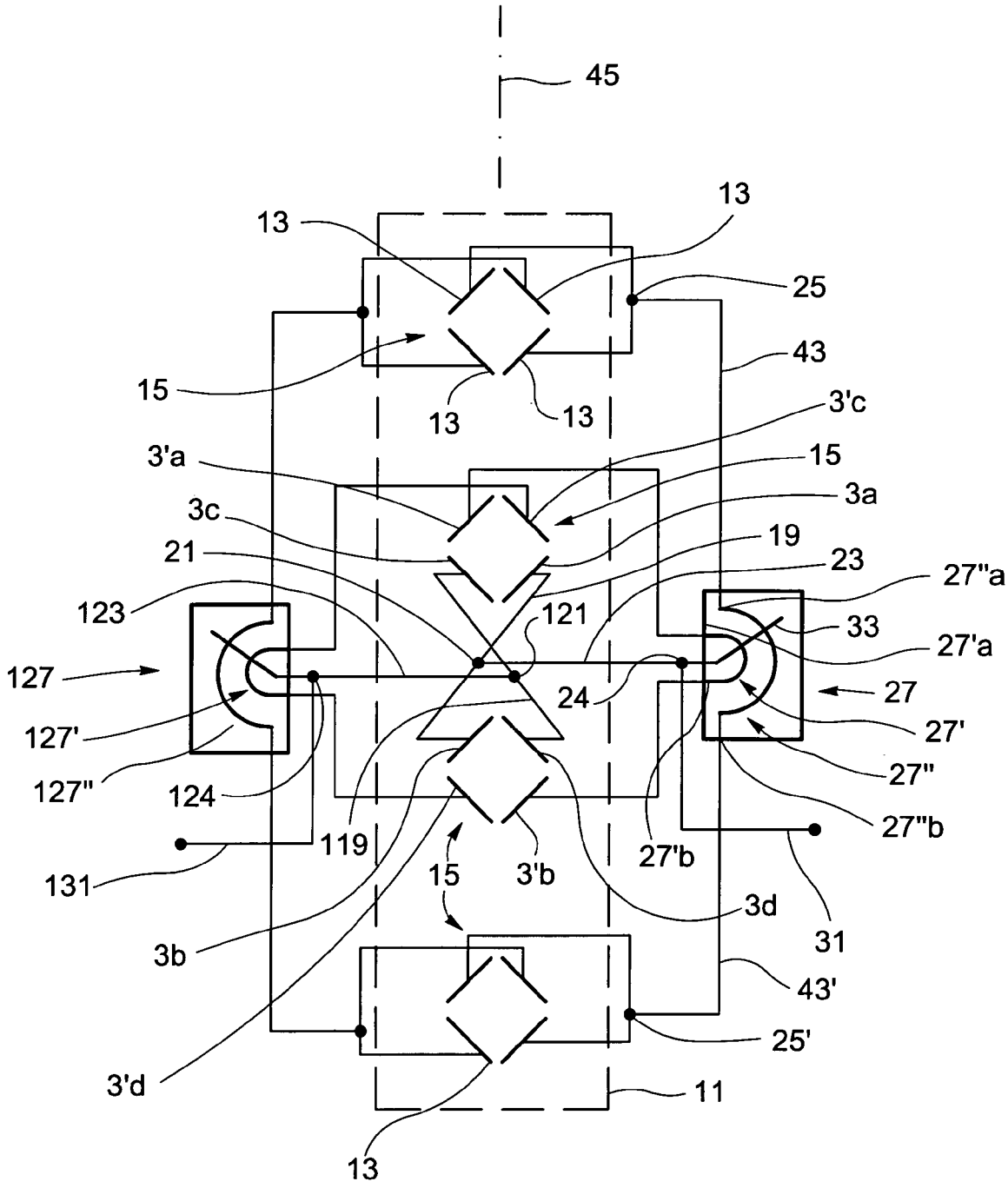
FIG. 1 shows a first exemplary implementation of an exemplary illustrative non-limiting antenna array having a square antenna element structure.

FIG. 1 shows an exemplary illustrative non-limiting dual-polarized antenna array. This comprises a large number of individual antenna elements 13 in front of a vertically aligned reflector 11, with four individual antenna elements 13 in each case forming a dipole square 15 in the illustrated exemplary arrangement. According to the exemplary non-limiting arrangement shown in FIG. 1, four dipole squares 15 are arranged one above the other, fitted in the vertical direction, in front of the reflector 11. The individual antenna elements 13 in this case comprise dipole antenna elements, which are each arranged at an angle of +45° or −45° with respect to the vertical or horizontal, so that it is also possible to refer to this as a short X-polarized antenna array.

FIG. 1 shows that, by way of example, the individual antenna element 3*a*, which is aligned at an angle of +45° to the horizontal, of the second dipole square 15, counting from the top, is connected via a line 19 and via an addition point 21 and a feed line 23 to an associated input 24 of a phase shifter assembly 27. The corresponding dipole 3*b* of the dipole square 15 located underneath this and which is aligned parallel to the dipole 3*a* of the dipole square located above it (at an angle of +45° to the horizontal) is arranged offset horizontally with respect to this dipole 3*a*, seen in the horizontal direction. This dipole 3*b* is also connected via a corresponding line 19, the connection point 21 and the subsequent line 23 to the input 24 of the phase shifter assembly 27, that is to say it is connected to the common feed network line 31.

The two parallel dipole antenna elements 3*a* and 3*b* which have been explained in the illustrated exemplary non-limiting arrangement are those which are located closer to one another with respect to the two central dipole squares 15, individual antenna elements 3'*a* and 3'*b*, which likewise are parallel to them, of the two central dipole squares 15.

The phase shifter assembly 27 in the illustrated exemplary non-limiting arrangement comprises two integrated phase shifters 27' and 27" so that appropriate phase shifts can be produced via a common feed network line 31 and a phase shifter adjustment element 33 which can be rotated in the form of a vector, thus making it possible to set depression angles of different magnitude, for example between 2° and 8°. For this purpose, the two first parallel dipoles, which are arranged at an angle of +45° with respect to the horizontal, are associated with the output 27"*a* via a line 43 and an addition point 25 while, in contrast, the other output 27"*b* is likewise electrically connected to the two dipoles 13, which are aligned at an angle of +45° to the horizontal, of the lowermost dipole square 15, via a subsequent line 43' and a downstream addition point 25' and subsequent lines. With regard to other aspects of the design and method of operation, reference is made to the prior publication DE 199 38 862, which is included in the content of this application.

The dipole 3'*a*, which is parallel to the dipole 3*a*, is connected to the one output 27'*a*, and the dipole 3'*b*, which is associated with the third dipole square and is parallel to the dipole 3*b*, is connected to the second input 27'*b* via a corresponding line.

In the illustrated exemplary non-limiting arrangement, the feed line 31 is furthermore connected not only to the phase shifter adjustment element 33 but, branching off from there, via an addition or division point 21 and two branch lines 19, which originate from there, firstly to the dipole 3*a* (which is aligned at an angle of 45°) of the second dipole square 15, and secondly to the dipole 3*b*, which is parallel to this, of the third dipole square, counting from the top.

If the polar diagram is now intended to be depressed, then the phase shifter adjustment element 33 is adjusted appropriately. In consequence, the two parallel dipoles 13, which are aligned at an angle of +45°, in the uppermost dipole square 15 and in the lowermost dipole square 15 are fed with different phases via the two associated outputs of the phase shifter 27". The dipole 3'*a* of the second dipole square and the dipole 3'*b*, which is parallel to it but is horizontally offset with respect to it, of the third dipole square, are also fed with different phases by the further phase shifter 27'. The parallel dipoles 3*a* and 3*b*, which are connected to the feed line 31 via the common branch lines 19, of the second and third dipole squares are fed with the same phase angle, without any change. As a result, the dipole antenna element group two and three, that is to say the respectively parallel dipoles in the second and third dipole squares (that is to say the two central dipole squares in FIG. 1), are now thus fed with different phase angles with respect to one another as a function of the depression angle of the antenna array, thus resulting in the desired compensation. This is because the second and third dipole squares now produce respective polar diagrams which do not drift away from one another in the azimuth direction overall as the depression angle of the polar diagram of the antenna array becomes greater, but are adjusted in the opposite direction, that is to say producing the desired compensation. Furthermore, the desired level of compensation can be adjusted by appropriate power splitting in the phase shifter assembly 27.

The compensation device or compensation arrangement that has been explained makes it possible to counteract the undesirable drifting apart from one another when the main lobes of the antenna array are depressed. Without using the exemplary illustrative non-limiting solution herein, the horizontal polar diagram or azimuth polar diagram for one polarization and the other polarization would, as stated, otherwise drift apart from one another in the horizontal or azimuth direction. In this case, furthermore, it should also be noted that the horizontal polar diagram is normally measured as a section through the main lobe, that is to say in the main lobe direction. In consequence, a conical section is produced when the main lobe is electrically depressed.

The exemplary illustrative non-limiting arrangement explained so far also shows that the compensation device or compensation arrangement which has been explained can be implemented both partially and on its own by corresponding antenna elements of the antenna array being interconnected in a completely novel manner in order to counteract this drifting apart.

The corresponding design and the corresponding method of operation have been explained for the dipoles aligned at an angle of +45°. The design for all the further dipoles, which are aligned at an angle of −45°, of the individual dipole squares is furthermore correspondingly symmetrical with respect to a phase shifter assembly 127, which is also shown on the left in FIG. 1, with an inner phase shifter 127' and an outer phase shifter 127", as well as a common feed network line 131. The two dipole antenna elements 3*c* and 3*d* which are aligned at an angle of −45° are thus connected via a common connecting line 119 and by a common addition point via a subsequent line 123 to the input 124 of the further phase shifter assembly 127, to which the common feed network line 131 leads. The further individual antenna elements 3'*c* and 3'*d* which are respectively parallel to the further individual antenna elements 3*c* and 3*d*, which are adjacent to one another and have already been mentioned, are connected in a comparable manner to the individual antenna elements 3'*a* and 3'*b* to the phase shifter assembly 127. This also results in the respective two parallel pairs of individual dipoles of the second and third dipole square which are aligned at −45° being fed with a phase difference which is dependent on the depression angle of the antenna and which is produced by the phase shifter assembly located in the antenna. The second and third phase shifter assemblies thus form the desired compensation device for varying the way in which the polar diagrams drift apart from one another when the polar diagrams are depressed. Conversely, of course, the desired half beam-width is also maintained and is not changed when the polar diagram is raised.

A dual-polarized antenna array which is known from the prior art will now be described with reference to FIG. 2, in order once again to explain the differences from the exemplary illustrative non-limiting antenna array.

Figure 2:
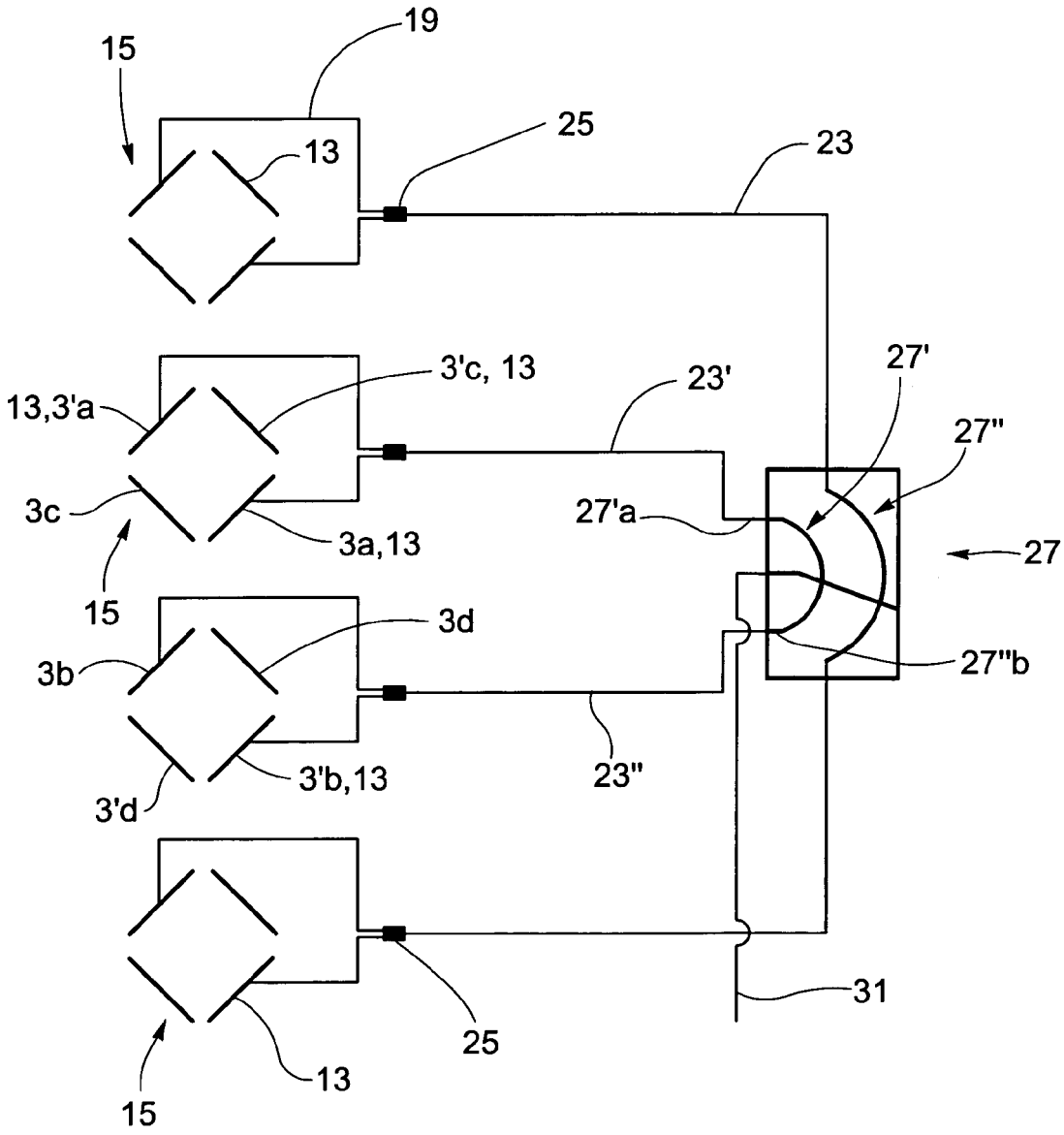
FIG. 2 shows an exemplary arrangement that is modified from that shown in FIG. 1, in order to explain an antenna array which is known from the prior art.

The exemplary antenna array shown in FIG. 2 now relates to an antenna array which is known from the prior art. This differs from the exemplary illustrative non-limiting antenna array as illustrated in FIG. 1 in that not only the two outer dipole squares are still connected to one another as shown in FIG. 1, that is to say in each case two parallel dipoles 13 for the +45° polarization are thus likewise permanently connected to one another in the same way as for the −45° polarization, but that now also, in the case of the central dipole squares, the respective two pairs of parallel dipoles are fed via a common feed line, that is to say with the same phase angle, or are fed with a phase angle with respect to one another which, although different, is predetermined in a fixed manner and cannot be varied while the polar diagram is depressed.

Thus, in this exemplary embodiment shown in FIG. 2, the two parallel dipoles 3*a* and 3'*a* are jointly connected to one input 27'*a* of the phase shifter assembly. The two dipoles 3*b* and 3'*b*, which are likewise aligned parallel to one another, in the next antenna element group located underneath this, that is to say in the next antenna element square located underneath this, are also interconnected via the line 23" and are conductively connected to the other output of the same phase shifter group 27'. Thus, in the case of this antenna array according to the prior art, each of the four antenna element arrangements shown, that is to say each of the four antenna element groups which are arranged one above the other and are formed from a dipole square, are set only with respect to one another, that is to say with respect to a next antenna element group of a different phase angle via the phase shifter assembly so that as a result, overall, only the depression angle can be varied electrically. However, this results in the undesirable drifting apart of the polar diagrams in the horizontal or azimuth direction. These disadvantages also occur when the respective dipoles which are fed jointly in pairs are no longer fed with identical phase angles, but possibly with phase angles which, although different, are preset such that they are fixed with respect to one another.

Merely to assist clarity, FIG. 2 does not show the phase shifter assembly 27 that is required for the second polarization, or the associated feed lines for the other polarization. However, to this extent, the design is identical.

Figure 3:
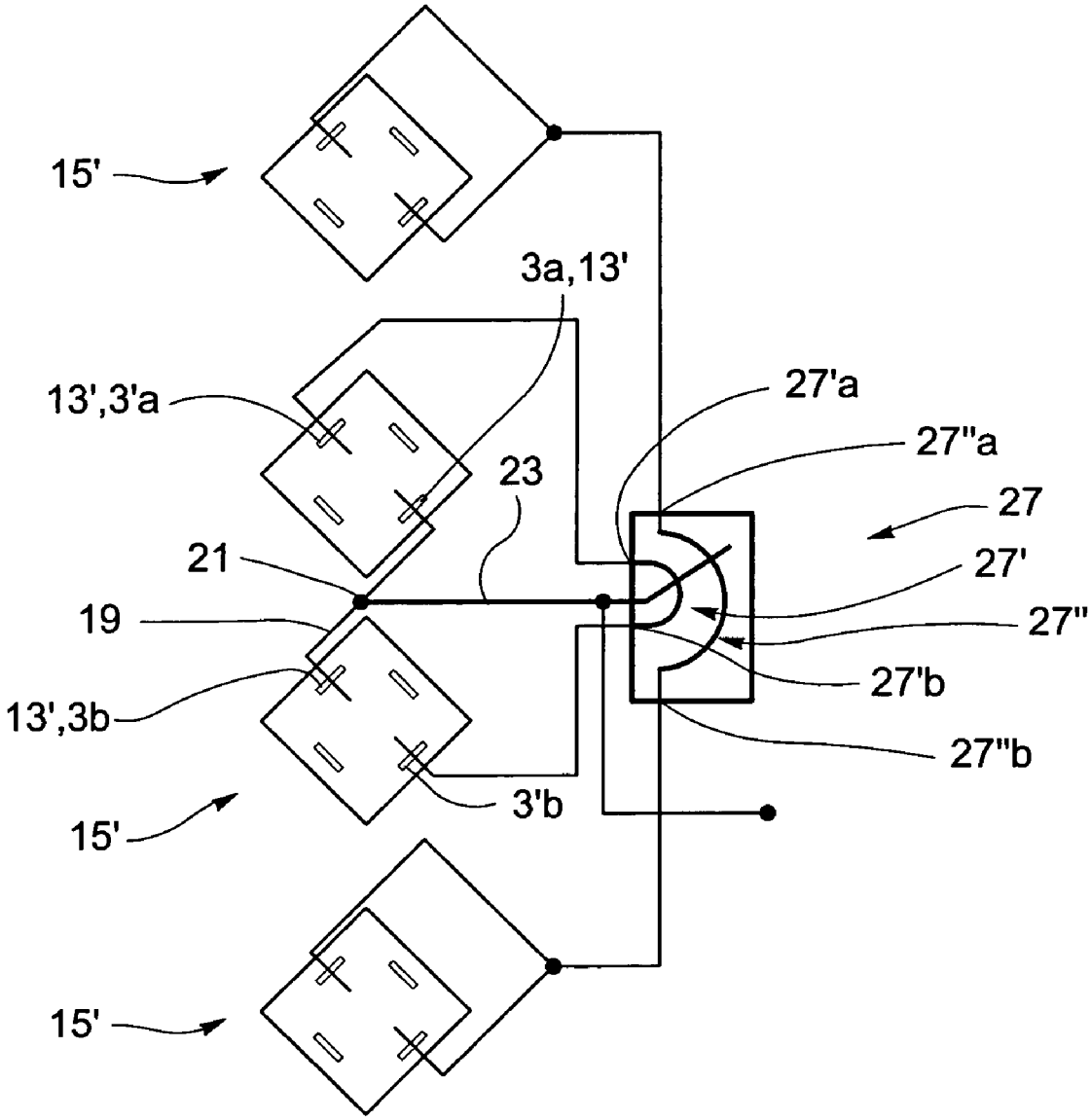
FIG. 3 shows an exemplary illustrative non-limiting arrangement which corresponds in principle to that shown in FIG. 1, in which antenna elements in the form of patch antenna elements with a square antenna element structure are used instead of antenna elements in the form of dipole squares.

The following text refers to the exemplary illustrative non-limiting arrangement as shown in FIG. 3, which largely corresponds to that shown in FIG. 1, but with the difference that individual antenna elements in the form of patch antenna elements 15' are used as the antenna elements, rather than dipoles 13 joined together in the form of dipole squares. The individual or patch antenna elements 15' in the illustrated exemplary non-limiting arrangement shown in FIG. 3 are designed such that they each have two pairs of feed points 13' which, in the illustrated exemplary non-limiting arrangement, are provided on corresponding slots, which are aligned in pairs parallel to one another. The individual or patch antenna elements 15' are in this case designed such that they transmit or receive at an angle of +45° and at an angle of −45° with respect to the vertical, to the extent that, functionally, they are comparable to the dipole squares shown in FIG. 2.

With reference to the two central patch antenna elements 15' with a square structure, the correspondingly positioned feed points 13' are likewise once again connected such that, with respect to the two central patch antenna elements 15' (which are aligned at an angle of +45° to the horizontal), the feed point 3'*a* is electrically connected to the first output 27'*a*, and the feed point 3'*b*, which is located offset with respect to this in the vertical and horizontal directions, of the third patch antenna element 15' is electrically connected to the second, with respect to this, output 27'*b* of the phase shifter 27', with the feed points 3*b* and 3*a* which transmit or receive using the same polarization once again being electrically interconnected via a common connecting line 19 and being electrically connected from a common connection point 21 via a subsequent line 23 to the corresponding input of the phase shifter assembly 27, and hence to the feed network line 31. A further phase shifter assembly 127 is provided in this exemplary non-limiting arrangement as well, and is required for the feed points provided for the other polarizations. To this extent, the design once again corresponds to this.

In this case as well, the two central individual or patch antenna elements 15' are used as a compensation device, in which the respective pairs of interacting feed points 3'*a* and 3*a* or 3*b* and 3'*b* are fed with a phase difference which is dependent on the depression angle of the antenna, and which is produced by the phase shifter assembly located in the antenna. Furthermore, the compensation level can once again be set and finely adjusted by means of the power splitting which is possible via the phase shifter assembly 27.

Figure 4:
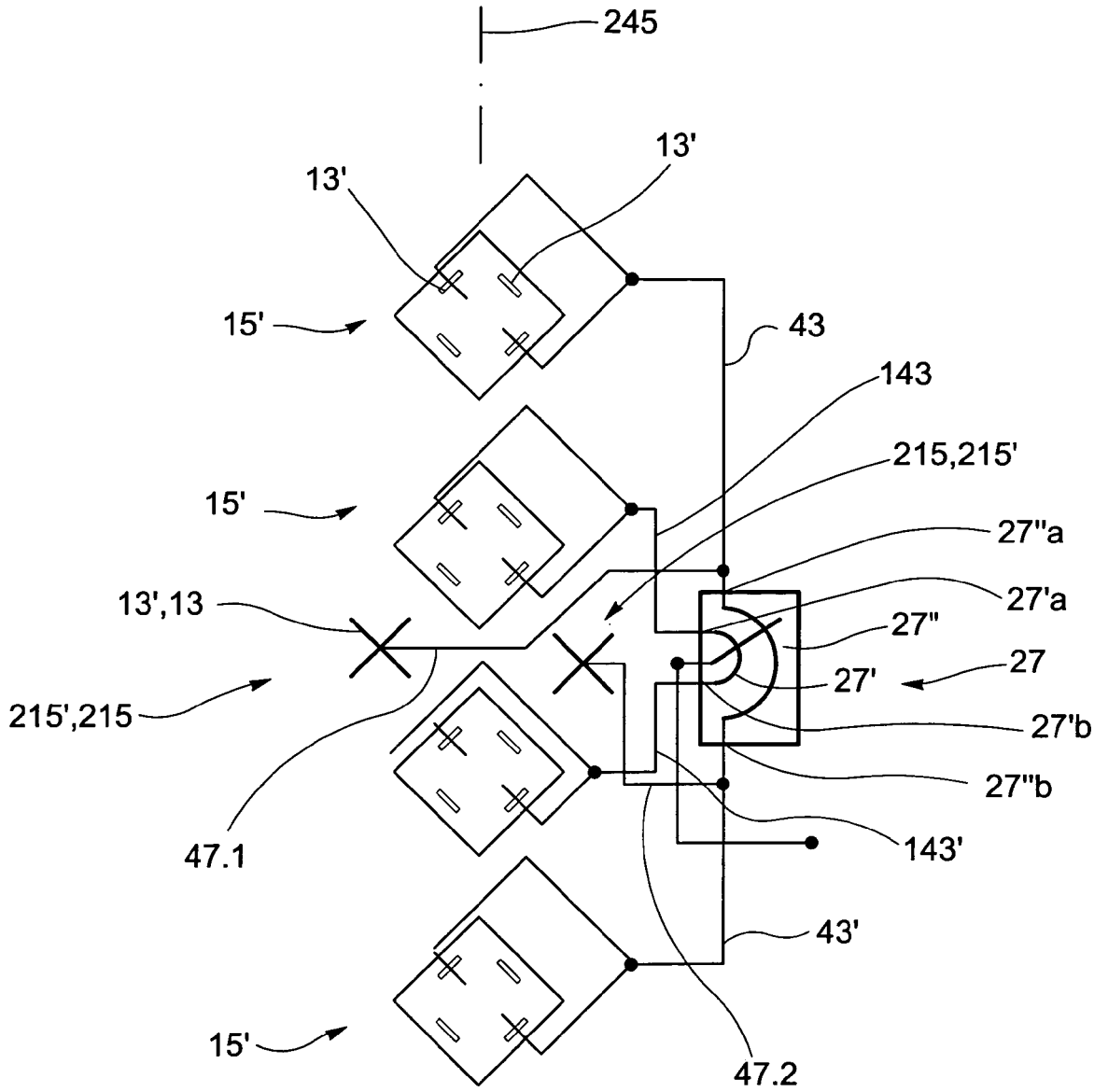
FIG. 4 shows a further exemplary illustrative non-limiting arrangement, with additional antenna elements in order to avoid tracking.

The exemplary non-limiting arrangement shown in FIG. 4 is fundamentally based on the same principle as that shown in FIG. 1 or FIG. 3. However, in this exemplary non-limiting arrangement, additional antenna elements 315 are used to compensate for tracking, and cause the polar diagram to be swiveled horizontally as a function of the depression angle. In the exemplary non-limiting arrangement shown in FIG. 4, four patch antenna elements 15' are used, which each have feed points 13' that interact in pairs for one of the two orthogonal polarizations. The feed points 13', which are opposite one another in pairs, are in each case permanently connected to one another as shown in FIGS. 1 and 3 for the outermost patch antenna elements 15' that are illustrated there. In this case, the feed points 13' (which are shown in FIG. 4) of the uppermost and lowermost patch antenna element 15' are each electrically connected via corresponding respective lines 43 and 43' to the respective inputs 27"*a* and 27"*b* of one phase shifter assembly 27", and the parallel feed points 13' of the two central patch antenna elements 15', which are adjacent to one another, are electrically connected via respective separate lines 143 and 143' to the two respective inputs 27'*a* and 27'*b* of the further phase shifter assembly 27'. This exemplary non-limiting arrangement that has been explained to this extent corresponds to an antenna array as has been explained with reference to FIG. 2 and which is known from the prior art but which, in contrast to FIG. 2, is not designed using dipole structures but using patch antenna elements.

In this exemplary non-limiting arrangement shown in FIG. 4, however, a feed for an additionally provided cruciform dipole or for a slot antenna element or patch antenna element 215 is now connected to the respective input 27"*a* or 27"*b* of the phase shifter 27" via a respective additional line 47.1 or 47.2. These two additional antenna elements 215—assuming that they are in the form of dipole cruciforms—thus comprise two dipole antenna elements 13 which are aligned at an angle of +45° to the horizontal, and two dipole antenna elements 13 which are aligned at an angle of −45° to the horizontal. However, patch antenna elements 215', for example, may also be used instead of dipole cruciforms 215, and comprise feed points 13' in order to transmit and to receive with a polarization of +45° and with a polarization of −45°. In both cases, this ensures that the antenna array comprises individual antenna elements 13 which are horizontally offset and feed points 13' which are horizontally offset (to be precise with respect to the +45° polarization and with respect to the −45° polarization), so that the desired compensation effect can be achieved as in the case of the other exemplary non-limiting arrangement that have been explained. In this exemplary non-limiting arrangement as well, the additional antenna elements 215 and 215' are once again arranged symmetrically with respect to the vertical axis of symmetry 245.

In this exemplary embodiment as well, the further phase shifter assembly 127 with the two phase shifters 127' and 127" as well as the associated connecting lines to the further individual antenna elements 15' and to the antenna element arrangements for the compensation device for the −45° polarization have been omitted in order to make the illustration clearer, and reference should in this context be made to the comparable design as has been explained with reference to FIG. 1.

Thus, in the exemplary non-limiting arrangement shown in FIG. 4, the compensation device comprises additional antenna element arrangements which are arranged offset in the horizontal direction and which, for example, may be formed from cruciform dipole structures 215, square dipole structures, or else from patch antenna elements 215' each having one feed point for both polarizations, or each having a pair of feed points for each polarization. Slotted antenna elements are also in principle suitable for this purpose.

The corresponding feed is provided via lines 47.1 and 47.2, so that these individual antenna elements or feed points are likewise once again fed with a phase difference which is dependent on the depression angle of the antenna. In this case as well, the phase difference can be produced by the phase shifter assembly that is located in the antenna.

Figure 5:
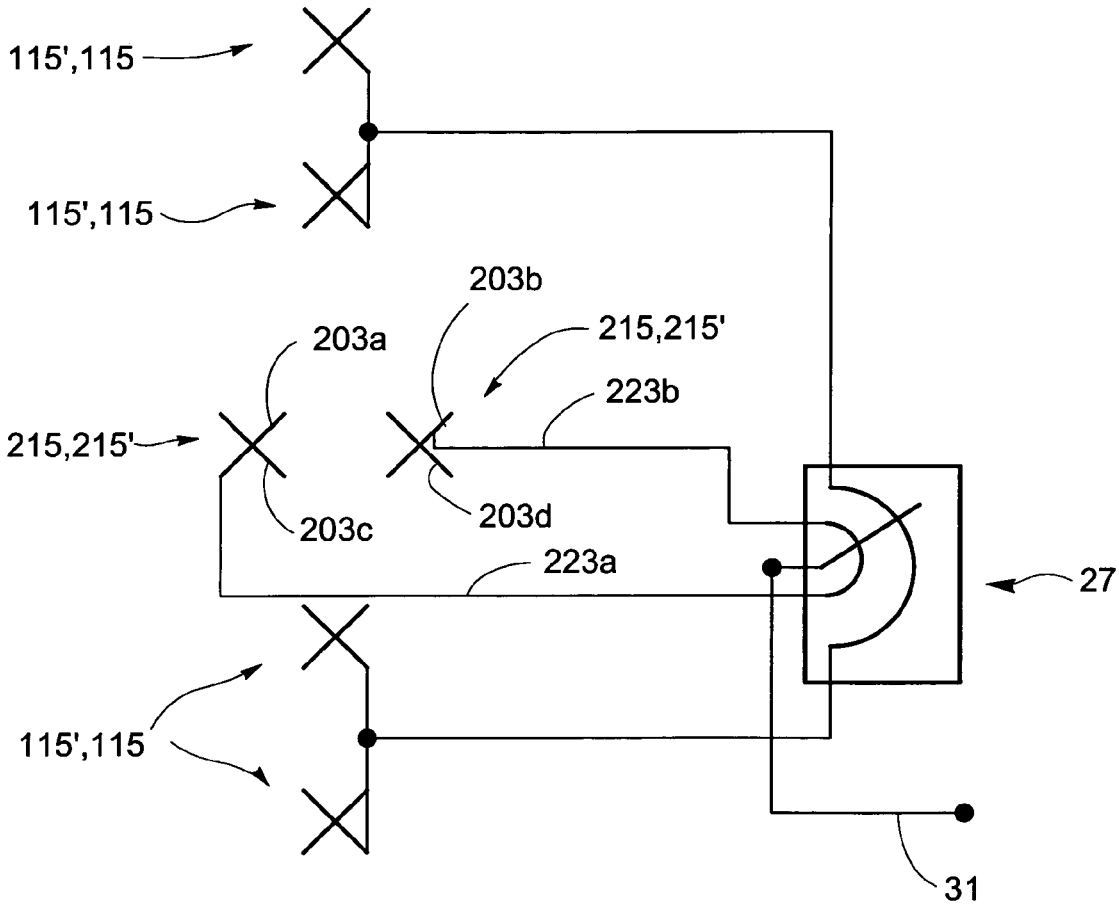
FIG. 5 shows an exemplary non-limiting antenna array with a cruciform antenna element structure with additional antenna elements with a horizontal offset in order to avoid tracking.

FIG. 5 will be used to show how the exemplary illustrative principle is fundamentally used not only for antenna elements with a square antenna element structure (that is to say, for example, a dipole square corresponding to FIG. 1 or patch antenna elements each having pairs of interacting feed points 13' as shown in FIG. 4) but also for cruciform dipole antenna elements 115 (for example dipole cruciforms) or patch antenna elements 115' with a cruciform antenna element structure (in the form of in each case one feed point for each polarization) which, from the start, may be arranged for example only in the vertical direction, and not with any horizontal offset with respect to one another.

In this exemplary non-limiting arrangement as shown in FIG. 5 as well, the additional antenna elements 215, 215' make it possible to provide the desired compensation when the polar diagram is depressed, in order to avoid the polar diagrams drifting apart from one another, in accordance with the explained tracking process.

For this purpose, in the case of this exemplary non-limiting arrangement shown in FIG. 5 and in contrast to an antenna array as known from the prior art with cruciform dipole structures 115 or patch antenna elements 115' arranged only one above the other in a vertical alignment (which will also be referred to for short as cruciform antenna elements in the following text), provision is made for, for example, two compensation antenna element arrangements 215 and 215', which are arranged alongside one another with a horizontal offset, now to be provided instead of two cruciform antenna elements, which are arranged one above the other vertically, in the center of the antenna array. In this case, the two dipole antenna elements 203*a* and 203*b*, which are aligned parallel and at an angle of +45° to the horizontal, are connected via respective lines 223*a* and 223*b* to the respective output 27'*a* or 27'*b* of the inner phase shifter assembly 27'. The respectively parallel dipoles (which are aligned at an angle of −45° in the illustrated exemplary non-limiting arrangement) of the dipole cruciforms 215, or the corresponding patch antenna elements 215' of the compensation antenna elements, are in each case connected in pairs (that is to say with respect to the two upper and the two lower antenna element structures in FIG. 5) to a phase shifter assembly which is provided separately for this purpose. The same applies to the −45° alignment of the individual antenna elements of the two additional antenna element arrangements 215 and 215', which are likewise connected to a separate phase shifter assembly. The design is in this case once again largely symmetrical with respect to the exemplary non-limiting arrangement, only part of which is illustrated in FIG. 5, as has been explained elsewhere with reference to FIG. 1.

A corresponding electrical connection is provided for the respective dipoles that are aligned with the other polarization via a further phase shifter assembly, which is not shown in FIG. 5 but is located on the left and corresponds to the exemplary non-limiting arrangement shown in FIG. 1. The two central dipoles 203*c* and 203*d*, which are provided with a horizontal offset and are aligned at an angle of −45°, are also electrically fed in a corresponding symmetrical manner via this phase shifter assembly.

In this case as well, patch antenna elements 215' could thus be used instead of the cruciform dipole structures 115, as has been explained with reference to FIG. 3. In this case, for an antenna array as shown in FIG. 5, the additional compensation antenna elements 215, 215' which are provided with a horizontal offset may be formed, in contrast to FIG. 5, not only with a cruciform antenna element structure (cruciform or square dipole structure), but it would also be possible to use patch antenna elements, each having two pairs of feed points as shown in FIG. 3 or 4, as compensation antenna elements. The compensation device shown in FIG.

5 with the two antenna element arrangements 215 and 215' which are arranged offset in the horizontal direction is thus to this extent designed such that it is comparable to the compensation device shown in FIG. 4.

In contrast to the preceding exemplary non-limiting arrangement, it should be noted that the additional antenna elements which are provided with a horizontal offset do not necessarily need to have the same polarization as the individual antenna elements 13. This means that it is also feasible to use vertically polarized antenna elements for this purpose. In this case, separate additional antenna elements must then be provided, for example, in order to compensate for the +45° polarization and the −45° polarization, and must be connected or coupled to a variable phase feed path, preferably by means of a suitable constellation or other coupling elements such as directional couplers for example.

Figure 6:
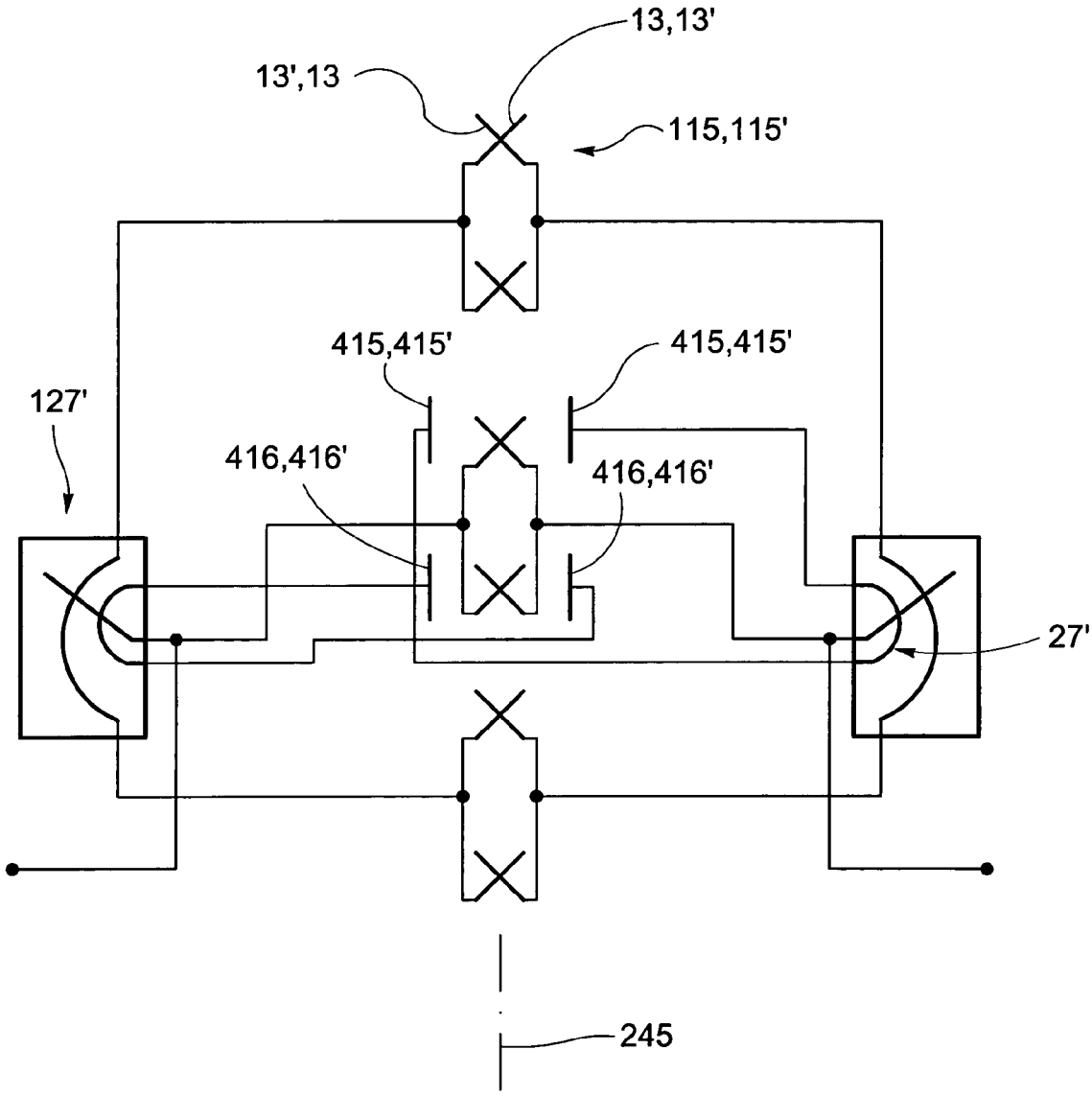
FIG. 6 shows a further exemplary illustrative non-limiting arrangement, with additional antenna elements in the form of vertical antenna elements in order to avoid tracking.

In this context, FIG. 6 shows a corresponding exemplary non-limiting arrangement, in which the antenna array fundamentally comprises only cruciform antenna elements 115, which are arranged one above the other with a vertical offset, that is to say with the individual dipole antenna elements 13 which are aligned parallel to one another not having any horizontal lateral offset with respect to one another. Instead of the dipole cruciforms 13 or the cruciform dipole structures, it also possible, however, to use square dipole structures (dipole squares) or corresponding patch antenna elements 13'. The exemplary illustrative non-limiting arrangement can be implemented in the same way in all these examples if compensation or additional antenna elements 415, which are also arranged with a horizontal offset, are likewise once again provided in addition to the antenna elements, antenna element arrangements or antenna element groups that are arranged vertically one above the other. This exemplary non-limiting arrangement in this case relates to vertical antenna elements 415, with vertical antenna elements 415 in each case being provided in pairs, and in this case a vertical antenna element 415 on the one hand being provided on the left, when the antenna array shown in FIG. 6 is viewed from the front, and a further vertical antenna element 415 on the other hand being arranged on the right of the vertical plane of symmetry 245, in each case aligned vertically, and with these two antenna elements in this case being connected to the two inputs of an associated phase shifter assembly 27'. Furthermore, a second pair of vertical antenna elements 416 are provided, with the two associated individual vertical antenna elements being arranged such that they are aligned vertically and symmetrically with respect to the central vertical axis or plane 245, to be precise underneath the first antenna element pair 415 when viewed in a vertical alignment. These second vertical antenna elements 415 are then also connected via appropriate lines to an associated phase shifter assembly 127', that is to say to the two associated outputs of this phase shifter assembly 127', via which the individual antenna elements or dipole antenna elements which are aligned at −45° are fed. This exemplary non-limiting arrangement can also once again be used in an appropriate manner for patch antenna elements 415, as well.

Figure 7:
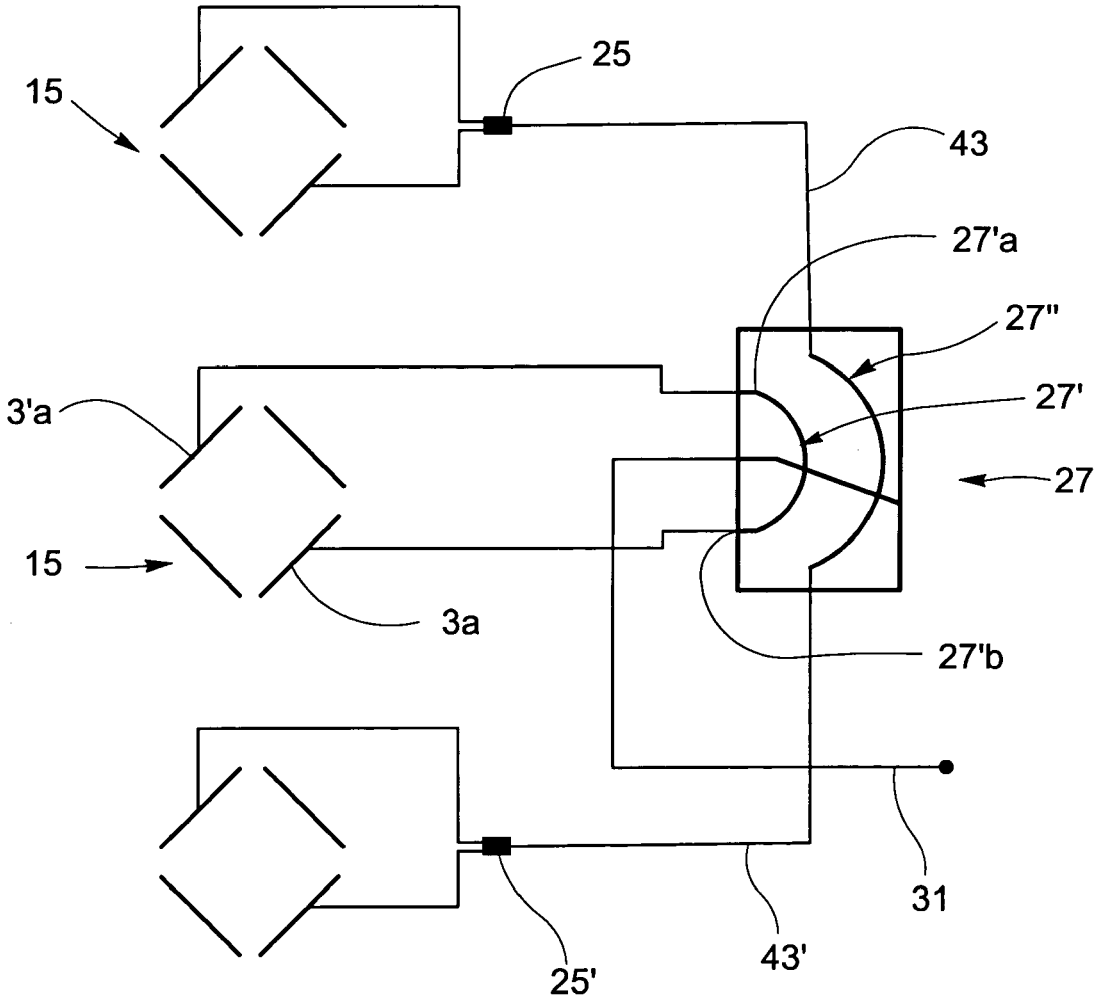
FIG. 7 shows a simplified exemplary non-limiting implementation, which has once again been modified from that shown in FIG. 1.

FIG. 7 will now be used as a basis for explaining how, in principle, one compensation device with only one compensation antenna element arrangement may also be adequate. In principle, FIG. 7 corresponds to the exemplary illustrative non-limiting arrangement shown in FIG. 1, but with the only difference being that only one dipole square 15 is provided instead of two central dipole squares which are associated with the compensation device. As shown in FIG. 7, the two respectively parallel dipoles 13, that is to say the dipoles 3*a* and 3'*a*, are fed with different phases depending on the depression angle of the polar diagram, for which purpose these two parallel dipoles are connected to the two inputs 27'*a* and 27'*b*. The two dipoles, which are arranged offset through 90° for this purpose, are then connected to a further phase shifter assembly 127, in a corresponding manner, as explained in principle in FIG. 1, for the second polarization. However, in this exemplary illustrative non-limiting arrangement, the phase shifter assembly is not likewise used in an optimal manner as in the case of FIG. 1. This is because, in the exemplary non-limiting arrangement shown in FIG. 1, the first phase shifter arrangement 27' can be used to compensate for two dipole squares while, in contrast, in the exemplary non-limiting arrangement shown in FIG. 7, this phase shifter 27' can be used only for driving one dipole square in a corresponding manner. In this exemplary non-limiting arrangement as well, a corresponding designed patch antenna element may, of course, be used instead of the dipole square as explained, via which the respective two pairs of feed points are fed for one polarization and for the other polarization.

While the technology herein has been described in connection with exemplary illustrative non-limiting implementation, the invention is not to be limited by the disclosure. The invention is intended to be defined by the claims and to cover all corresponding and equivalent arrangements whether or not specifically disclosed herein.

What is claimed is:

1. A dual-polarized antenna array having a main lobe which can be depressed, said array having a changeable down tilt angle, said antenna array comprising:

a reflector;

plural antenna element arrangements, at least some of which are arranged on different height lines when seen in the vertical direction in front of the reflector, the antenna element arrangements being constructed and arranged for radiating and/or receiving two polarizations at right angles to one another, with the polarizations being aligned at an angle, inclined to the vertical, of approximately +45° on the one hand and −45° on the other hand, the antenna element arrangements comprising:

dipole structures, the plural antenna element arrangements further comprising a compensation arrangement for compensating for movement drift, as a function of the depression angle, of the horizontal overall polar diagram in the horizontal or azimuth direction for at least one of said polarizations, the compensation arrangement comprising at least one adjustable compensation antenna element arrangement, whose associated polar diagram is changed or shifted in the opposite sense to the polar diagram of the at least one other antenna element arrangement as the polar diagram is increasingly depressed.

2. The dual-polarized antenna array as claimed in claim 1, wherein:

the compensation antenna element arrangement comprises, with respect to the relevant polarization, at least one pair of dipole antenna elements, which are fed with a phase difference which depends on the depression angle of the antenna array, and the at least one pair of dipole antenna elements are ranged with a horizontal offset with respect to one another or are at a distance from one another, at least when seen in the horizontal direction.

3. The dual-polarized antenna array as claimed in claim 2, wherein the pain of dipole antenna elements which are arranged at least with the horizontal component offset with respect to one another and are driven by a phase difference which is dependent on the depression angle form a square dipole structure, in the form of a dipole square.

4. The dual-polarized antenna array as claimed in claim 2, wherein the pairs of dipole antenna elements which are ranged at least with the horizontal component offset with respect to one another and are driven by a phase difference which is dependent on the depression angle form a cruciform dipole structure, in the form of two cruciform dipoles which are arranged at least with the horizontal components offset with respect to one another.

5. The dual-polarized antenna array as claimed in claim 1, wherein:

the compensation antenna element arrangement comprising, with respect to the relevant polarization, at least one patch antenna element with two feed points, or at least two patch antenna elements with at least one feed point, with the respective at least two feed points being arranged with a horizontal offset with respect to one another, or at a distance from one another, at least in the horizontal direction.

6. The dual-polarized antenna array as claimed in claim 1, wherein the compensation antenna element arrangement is fed with phases which can be set differently via phase shifters in the form of phase shifter assemblies.

7. The dual-polarized antenna array as claimed in claim 1, wherein the compensation arrangement comprises power splitting with respect to the feeding of the compensation antenna element arrangements, by which means the level of compensation can be adjusted.

8. The dual-polarized antenna array as claimed in claim 1, wherein, in addition to the compensation antenna element arrangement, the antenna element arrangement comprising dipole structures, in the form of cruciform or cruciform-like dipoles and/or dipole squares and/or in the form of patch antenna elements having at least one feed point for one polarization, and having two feed points for one polarization.

9. The dual-polarized antenna array as claimed in claim 1, wherein the further antenna element arrangements which are provided in addition to the compensation antenna element arrangement are constructed as group antenna elements, which comprise at least two dipoles for each polarization or, in the case of a patch antenna element, at least two feed points for each polarization, which are fed with the same phase angle or with a fixed predetermined phase angle with respect to one another.

10. A dual-polarized antenna array, having a main lobe which can be depressed, comprising:

plural antenna element arrangements, at least some of which are arranged on different height lines when seen in the vertical direction in front of a reflector, the antenna element arrangements being constructed and arranged such that two polarizations which are at right angles to one another can be received and/or transmitted via them, with the polarizations being aligned at an angle, inclined to the vertical, of approximately +45° on the one hand and −45° on the other hand, the antenna element arrangements comprising:

(a) dipole structures, in the form of cruciform or cruciform-like dipole structures or in the form of square dipole structures, and/or (b) patch antenna elements having at least two or four feed points, further including the following further features:

a compensation device or compensation arrangement for minimizing, for preventing or for overcompensation for movement drift, as a function of the depression angle, of the horizontal overall polar diagram in the horizontal or azimuth direction is provided for at least one or both polarizations, the compensation device or compensation arrangement comprising, with respect to the relevant polarization, at least one compensation antenna element device or at least one compensation antenna element arrangement, whose associated polar diagram is changed or shifted in the opposite sense to the polar diagram of the at least one other antenna element arrangement as the polar diagram is increasingly depressed, and wherein the compensation antenna element arrangement or compensation antenna element device comprises at least one pair of vertical or horizontal antenna elements for one polarization, which are arranged with a horizontal offset or spaced apart from one another in the horizontal direction, symmetrically with respect to a vertical central plane of symmetry, with the relevant pair of vertical antenna elements being fed with a phase difference which is dependent on the depression angle of the antenna.

11. A dual-polarized antenna array having a main lobe which can be depressed, comprising:

plural antenna element arrangements, at least some of which are arranged on different height lines when seen in the vertical direction in front of a reflector, the antenna element arrangements being constructed and ranged such that two polarizations which are at right angles to one another can be received and/or transmitted via them, with the polarizations being aligned at an angle, inclined to the vertical, of approximately +45° on the one hand and −45° on the other hand, the antenna element arrangements comprising:

(a) dipole structures, in the form of cruciform or cruciform-like dipole structures or in the form of square dipole structures, and/or (b) patch antenna elements having at least two or four feed points, further including the following further features:

a compensation device or compensation arrangement for minimizing, for preventing or for overcompensation for movement drift, as a function of the depression angle, of the horizontal overall polar diagram in the horizontal or azimuth direction is provided for at least one or both polarizations, the compensation device or compensation arrangement comprising, with respect to the relevant polarization, at least one compensation antenna element device or at least one compensation antenna element arrangement, whose associated polar diagram is changed or shifted in the opposite sense to the polar diagram of the at least one other antenna element arrangement as the polar diagram is increasingly depressed, and wherein, in the case of an antenna array having a compensation device or compensation arrangement with at least two dipole squares, the respectively parallel dipoles which are located closer together of the two dipole squares are connected to one another via a common connecting line, and are interconnected via an addition point, by means of an associated feed line.

12. The dual-polarized antenna array as claimed in claim 11, wherein, in the case of an antenna array having at least two dipole squares, the dipole which is in each case in parallel with the interconnected dipoles is connected to a separate input of a phase shifter.

13. A dual-polarized antenna array having a main lobe which can be depressed, comprising:

plural antenna element arrangements, at least some of which are arranged on different height lines when seen in the vertical direction in front of a reflector, the antenna element arrangements being constructed and arranged such that two polarizations which are at right angles to one another can be received and/or transmitted via them, with the polarizations being aligned at an angle, inclined to the vertical, of approximately +45° on the one hand and −45° on the other hand, the antenna element arrangements comprising:

(a) dipole structures, in the form of cruciform or cruciform-like dipole structures or in the form of square dipole structures, and/or (b) patch antenna elements having at least two or four feed points, further including the following further features:

a compensation device or compensation arrangement for minimizing, for preventing or for overcompensation for movement drift, as a function of the depression angle, of the horizontal overall polar diagram in the horizontal or azimuth direction is provided for at least one or both polarizations, the compensation device or compensation arrangement comprising, with respect to the relevant polarization, at least one compensation antenna element device or at least one compensation antenna element arrangement, whose associated polar diagram is changed or shifted in the opposite sense to the polar diagram of the at least one other antenna element arrangement as the polar diagram is increasingly depressed, and wherein, in the case of an antenna array having a compensation device or a compensation arrangement having at least two patch antenna element which each have two pairs of feed points, the feed points which are in each case closer for the relevant polarization are in each case connected to one another via a connecting line, and are means of an associated feed line.

14. The dual-polarized antenna array as claimed in claim 13, wherein, in case of an antenna array having at least two patch antenna elements which each have two feed points, the feed point, which is in each case the further feed point with respect to the interconnected feed points, of the relevant patch antenna element is connected to a separate input of a phase shifter.

15. A dual-polarized antenna array having a main lobe which can be depressed, comprising:

plural antenna element arrangements, at least some of which are arranged on different height lines when seen in the vertical direction in front of a reflector, the antenna element arrangements being constructed and arranged such that two polarizations which are at right angles to one another can be received and/or transmitted via them, with the polarizations being aligned at an angle, inclined to the vertical, of approximately +45° on the one hand and −45° on the other hand, the antenna element arrangements comprising:

(a) dipole structures, in particular in the form of cruciform or cruciform-like dipole structures or in the form of square dipole structures, and/or (b) patch antenna elements having at least two or four feed points, further including the following further features:

a compensation device or compensation arrangement for minimizing, for preventing or for overcompensation for movement drift, as a function of the depression angle, of the horizontal overall polar diagram in the horizontal or azimuth direction is provided for at least one or both polarizations, the compensation device or compensation arrangement comprising, with respect to the relevant polarization, at least one compensation antenna element device or at least one compensation antenna element arrangement, whose associated polar diagram is changed or shifted in the opposite sense to the polar diagram of the at least one other antenna element arrangement as the polar diagram is increasingly depressed, and wherein the compensation antenna element device or the compensation antenna element arrangement comprising a dipole square or a patch antenna element having two pairs of feed points for each polarization, with the mutually parallel dipoles of the square or the two feed points, which are provided for one polarization, of the patch antenna element of the compensation antenna element device or compensation antenna element arrangement being connected to the two inputs of a phase shifter.

16. A compensation antenna element arrangement comprising:

at least one pair of vertical or horizontal antenna elements for a common polarization, said at least one pair of antenna elements being arranged with a horizontal offset and/or spaced apart from one another in the horizontal direction, symmetrically with respect to the vertical central plane of symmetry;

a feed arrangement including a teed line, said feed arrangement feeding said at least one pair of antenna elements with a phase difference that is dependent on the depression angle of the antenna; and a compensation device coupled to said feed arrangement, said compensation device comprising at least two dipole squares providing parallel dipole elements, said parallel dipole elements being connected to one another via a common connecting line and being interconnected via an additional point by means of said feed line.

17. A dual-polarized antenna array having a main lobe which can be depressed, comprising:

plural antenna element arrangements, at least some of which are arranged on different height lines when seen in the vertical direction in front of a reflector, the antenna element arrangements being constructed and arranged such that two polarizations which are at right angles to one another can be received and/or transmitted via them, with the polarizations being aligned at an angle, inclined to the vertical, of approximately +45° on the one hand and −45° on the other hand, the antenna element arrangements comprising at least one of:

(a) dipole structures in the form of cruciform or cruciform-like dipole structures or in the form of square dipole structures, and (b) patch antenna elements having at least two or four feed points, the antenna element arrangements having at least one phase shifter or one phase shifter group, further including following further features:

a compensation device or compensation arrangement for minimizing, for preventing or for overcompensation for movement drift, as a function of the depression angle, of the horizontal overall polar diagram in the horizontal or azimuth direction is provided for at least one or both polarizations, wherein:

the compensation device or compensation arrangement comprising, with respect to the relevant polarization, at least one adjustable compensation antenna element device or at least one compensation antenna element arrangement, whose associated polar diagram is changed or shifted in the opposite sense to the polar diagram of the at least one other antenna element arrangement as the polar diagram is increasingly depressed, wherein:

the compensation antenna element device or compensation antenna element arrangement comprising, with respect to the relevant polarization, at least one patch antenna element with two feed points, or at least two patch antenna elements with at least one feed point, with the respective at least two feed points being arranged with a horizontal offset with respect to one another, or at a distance from one another, at least in the horizontal direction.

18. A dual-polarized antenna array having a main lobe which can be depressed, the antenna array, comprising:

a reflector:

plural dual-polarized antenna elements arranged in front of the reflector such that said elements are, in use, offset from one another in the vertical direction and the first and second polarizations are aligned at an angle, inclined to the vertical, of substantially ±45°, a compensation device for compensating for movement drift, as a function of the depression angle, of the polar diagram in the horizontal and/or azimuth direction for at least one of said first and second polarizations, the compensation device comprising at least one adjustable compensation antenna element device whose associated polar diagram is changed or shifted by an adjustable amount in the opposite sense to the polar diagram of the at least one other antenna element arrangement as the polar diagram is increasingly depressed.

19. The antenna array of claim 18 wherein the antenna elements comprise cruciform or cruciform-like dipole structures.

20. The antenna array of claim 18 wherein the antenna elements comprise square dipole structures.

21. The antenna array of claim 18 wherein the antenna elements comprise patch antenna elements.

22. The antenna array of claim 18 further including at least one adjustable phase shifter coupled to said antenna elements.

23. The antenna array of claim 18 wherein said compensation device comprises at least one patch antenna.

24. The antenna array of claim 18 wherein said compensation device comprises at least one pair of dipole antenna elements, which are fed with a phase difference which depends on the depression angle of the antenna array.

25. A dual-polarized antenna array having a main lobe which can be depressed, said array having a changeable down tilt angle, said antenna array comprising:

a reflector;

plural antenna element arrangements, at least some of which are arranged on different height lines when seen in the vertical direction in front of the reflector, the antenna element arrangements being constructed and ranged for radiating and/or receiving two polarizations at right angles to one another, with the polarizations being aligned at an angle, inclined to the vertical, of approximately +45° on the one hand and −45° on the other hand, the antenna element arrangements comprising patch antenna elements, and at least one phase shifter coupled to the antenna element arrangement, adjustment of the adjustable phase shifter adjusting the antenna array downtilt angle, the arrangement further comprising a compensation arrangement for compensating for movement drift, as a function of the depression angle, of the horizontal overall polar diagram in the horizontal or azimuth direction for at least one of said polarizations, the compensation arrangement comprising at least one adjustable compensation antenna element arrangement, whose associated polar diagram is changed or shifted in the opposite sense to the polar diagram of the at least one other antenna element arrangement as the polar diagram is increasingly depressed.

26. The antenna array of claim 25 wherein said patch elements have at least two feed points.

27. The antenna array of claim 25 wherein said patch elements have at least four feed points.

28. A dual-polarized antenna array, having a main lobe which can be depressed, comprising:

plural antenna element arrangements, at least some of which are arranged on different height lines when seen in the vertical direction in front of a reflector, the antenna element arrangements being constructed and arranged such that two polarizations which are at right angles to one another can be received and/or transmitted via them, with the polarizations being aligned at an angle, inclined to the vertical, of approximately +45° on the one hand and −45° on the other hand, the antenna element arrangements comprising;

(a) dipole structures, in the form of cruciform or cruciform-like dipole structures or in the form of square dipole structures, and/or (b) patch antenna elements having at least two or four feed points, further including the following further features:

a compensation device or compensation arrangement for minimizing, for preventing or for overcompensation for movement drift, as a function of the depression angle, of the horizontal overall polar diagram in the horizontal or azimuth direction is provided for at least one or both polarizations, the compensation device or compensation arrangement comprising, with respect to the relevant polarization, at least one compensation antenna element device or at least one compensation antenna element arrangement, whose associated polar diagram is changed or shifted in the opposite sense to the polar diagram of the at least one other antenna element arrangement as the polar diagram is increasingly depressed, and wherein the compensation antenna element arrangement or compensation antenna element device comprises at least one pair of antenna elements arranged such to receive or transmit in at least one polarization plane which is parallel to the at least one polarization plane in which the plural antenna elements are receiving or transmitting, which are arranged with a horizontal offset or spaced apart from one another in the horizontal direction with respect to a vertical central plane of symmetry, with the relevant pair of antenna elements arranged in parallel to the antenna element arrangements being fed with a phase difference which is dependent on the depression angle of the antenna.

* * * * *